United States Patent [19]

Preston

[11] Patent Number: 5,008,968

[45] Date of Patent: Apr. 23, 1991

[54] SHEET MATERIAL CLEANING MACHINE

[75] Inventor: Wallace Preston, West Springfield, Mass.

[73] Assignees: Markel Industries, Inc., Enfield, Conn.; Julie Associates, Inc., North Billerica, Mass.

[21] Appl. No.: 386,429

[22] Filed: Jul. 27, 1989

[51] Int. Cl.[5] ..... B08B 6/00

[52] U.S. Cl. ..... 15/1.51; 15/308

[58] Field of Search ..... 15/1.51, 308

[56] References Cited

U.S. PATENT DOCUMENTS

| | | | |
|---|---|---|---|
| 2,515,223 | 7/1950 | Hollick | 15/360 A X |
| 3,128,492 | 4/1964 | Hanscom et al. | 15/308 |
| 3,395,042 | 7/1968 | Herbert | 15/308 X |
| 3,574,261 | 4/1971 | Bailey | 15/306 A X |
| 3,986,223 | 10/1976 | Kiefer | 15/309 X |
| 4,281,431 | 4/1981 | Nierlich et al. | 15/306 A X |
| 4,667,419 | 5/1987 | Bovone | 15/306 B X |
| 4,715,078 | 12/1987 | Howard et al. | 15/309 X |

*Primary Examiner*—Chris K. Moore

*Attorney, Agent, or Firm*—McCormick, Paulding & Huber

[57] ABSTRACT

A machine for cleaning the upper and lower surfaces of a sheet of material and having a housing and a conveyor for driving the sheet through the housing and through first and second cleaning stations located therein. At the first cleaning station portions of the surfaces of the sheet exposed by the conveyor are cleaned by passing the sheet between ionization bars which neutralize static electrical charges on the sheet, air jets which blow light particulate matter from the surfaces of the sheet and rotary brushes which sweep the surfaces of the sheet. Portions of the sheet surfaces not exposed at the first cleaning station are exposed by the conveyor as the sheet passes through the second cleaning station, where it is further cleaned by similar cleaning apparatus. As the sheet leaves the housing, it passes another ionization bar which neutralizes static charges produced by frictional engagement of the air jets and rotary brushes with the sheet surfaces.

22 Claims, 5 Drawing Sheets

SHEET MATERIAL CLEANING MACHINE

BACKGROUND OF THE INVENTION

This invention relates in general to sheet material cleaning apparatus and deals more particularly with an improved machine for removing dust or other particulate matter from at least one surface of a sheet of material to be cleaned.

In commerce and industry numerous situations are encountered where substantially dust free flexible or rigid sheet material is required. In clean rooms and laboratories, for example, it is often necessary to provide wiping sheets and/or working surfaces which are substantially free of dust or other light particulate matter. Disposable sheet material liners are commonly used to provide such working surfaces. However, it is important that at least one surface of each such liner be substantially free of dust or other particulate contaminants.

Substantially dust free wrapping material is often required for packaging precision parts such as bearings and the like. Numerous other examples of situations requiring substantially dust free sheet material are found in the graphic and electronic arts.

It is the general aim of the present invention to provide an improved machine of simple durable construction for low cost manufacture to remove dust or other light particulate matter from at least one surface of a sheet of material and which is capable of processing either flexible or rigid sheet material of varying thickness.

SUMMARY OF THE INVENTION

In accordance with the invention an improved machine is provided for cleaning at least one surface of a sheet of material and which comprises conveying means for moving a sheet of material to be cleaned along a predetermined path while occluding a portion of the one surface as the sheet is advanced along a first portion of the path by the conveying means and for exposing preciously occluded of the one surface as the sheet is further advanced a second portion of the path. The machine also includes cleaning means for removing particulate matter from the exposed portion of the one surface as the sheet material advances along the first portion of the path and for removing particulate matter from the previously occluded portion of the one surface as the sheet material advances along the second portion of the path.

DETAILED DESCRIPTION OF PREFERRED EMBODIMENT

Figure 1:
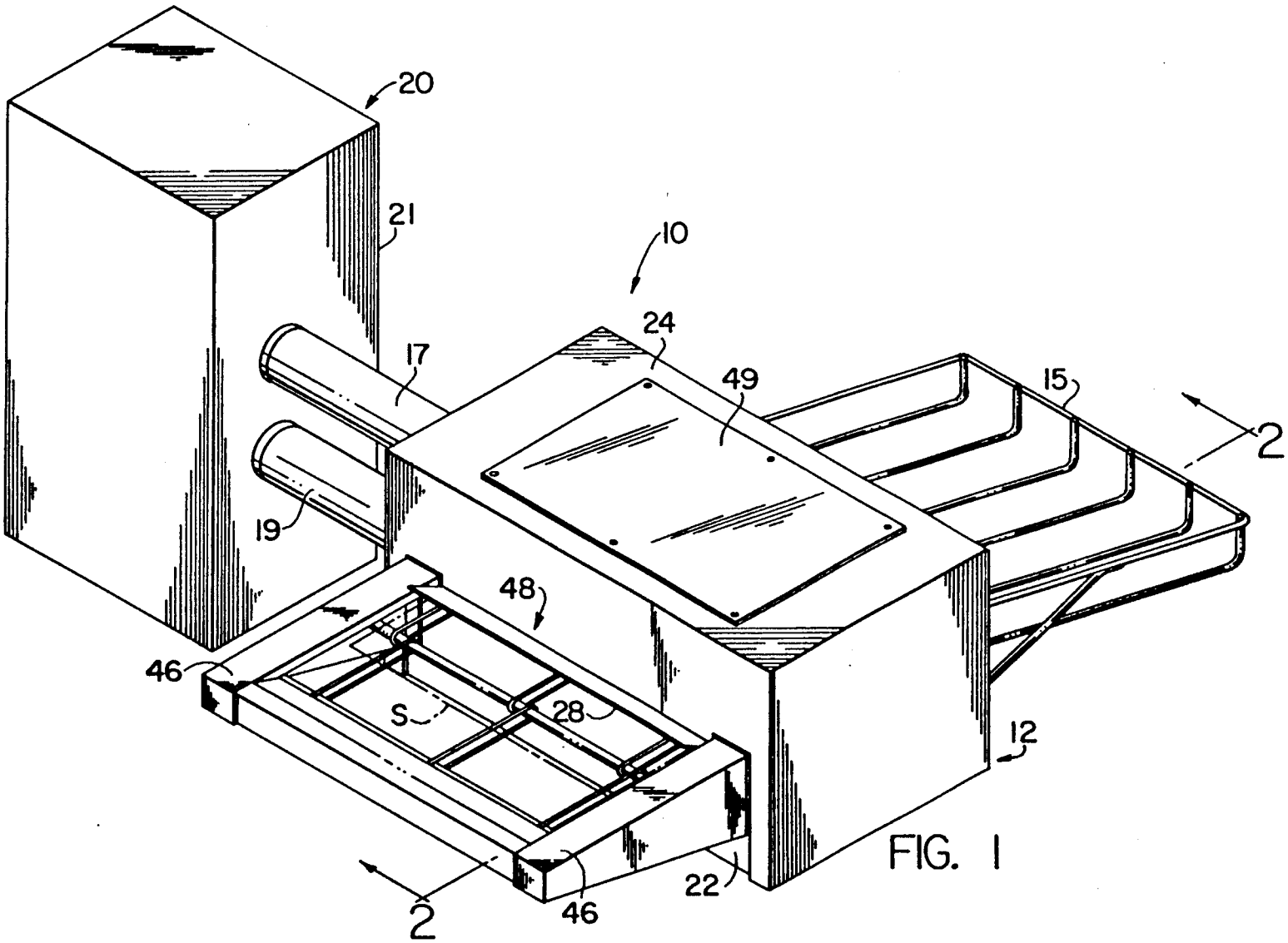
FIG. 1 is a perspective view of a machine for cleaning sheet material and embodying the present invention.

Apparatus for cleaning sheet material and embodying the present invention may be constructed and arranged to remove dust or other light particulate matter from either the upper or lower surface or both the upper and lower surfaces of sheet of material. However, in the drawings and description which follows, the invention is illustrated and described with reference to a cleaning machine indicated generally by the numeral 10 and particularly adapted to simultaneously clean both upper and lower surfaces of a sheet of material shown in phantom in FIG. 1 and designated generally by the letter S. The sheet S may be either rigid or flexible.

Figure 2:
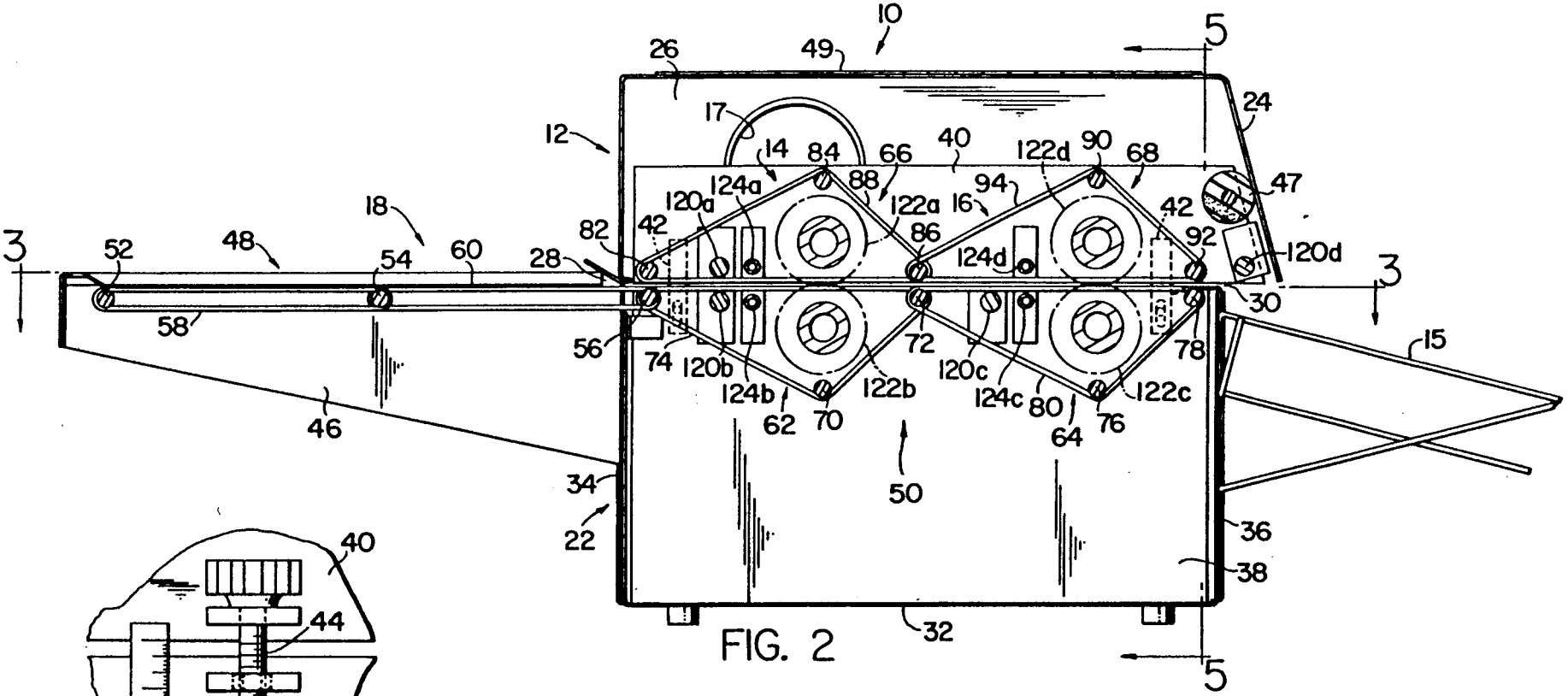
FIG. 2 is a somewhat enlarged fragmentary sectional view of the machine of FIG. 1 taken along the line 2—2 of FIG. 1.
Figure 6:
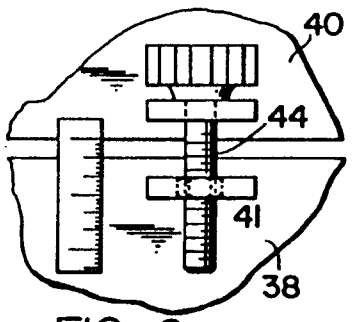
FIG. 6 is a somewhat enlarged fragmentary side elevational view of a vertical adjusting mechanism.

The illustrated machine 10 essentially comprises a housing, designated generally by the numeral 12, which defines a chamber 26 containing longitudinally spaced apart first and second cleaning stations indicated generally at 14 and 16 and best shown in FIG. 2. A conveyor assembly indicated generally at 18 extends into and through the housing for moving sheet material into the housing 12, driving it along a predetermined longitudinal path through the first and second cleaning stations 14 and 16, and discharging the cleaned sheet material from the housing and into an open wire frame or basket 15 at the rear of the machine 10. As a sheet, such as the sheet S, moves through the first cleaning station 14, portions of both the upper and lower surfaces of the sheet are first exposed by the conveyor assembly 18 to cleaning apparatus at the first cleaning station 14 which removes particulate matter from the exposed portions of the upper and lower surfaces of the sheet. As the advancing sheet S moves through the second cleaning station 16 those portions of the upper and lower surfaces of the sheet which were not exposed to the cleaning apparatus at the first cleaning station 14 are exposed by the conveyor assembly 18 to cleaning apparatus at the second cleaning station 16 where further surface cleaning operations are performed on the sheet. Dust or other particulate matter removed from the surfaces of the sheet S is withdrawn from the chamber 26 by an associated vacuum producing system 20 which includes one or more exhaust ducts 17 and 19 communicating with the chamber and connected to a suitable collector 21, all of which will be hereinafter more fully discussed.

Considering now the machine 10 in further detail, the housing 12 includes a frame 22 and a removable cover 24 which cooperates in assembly with the frame to define the chamber 26. Inlet and outlet openings or slots 28 and 30 at opposite ends of the housing communicate with the chamber 26 as best shown in FIG. 2.

Figure 5:
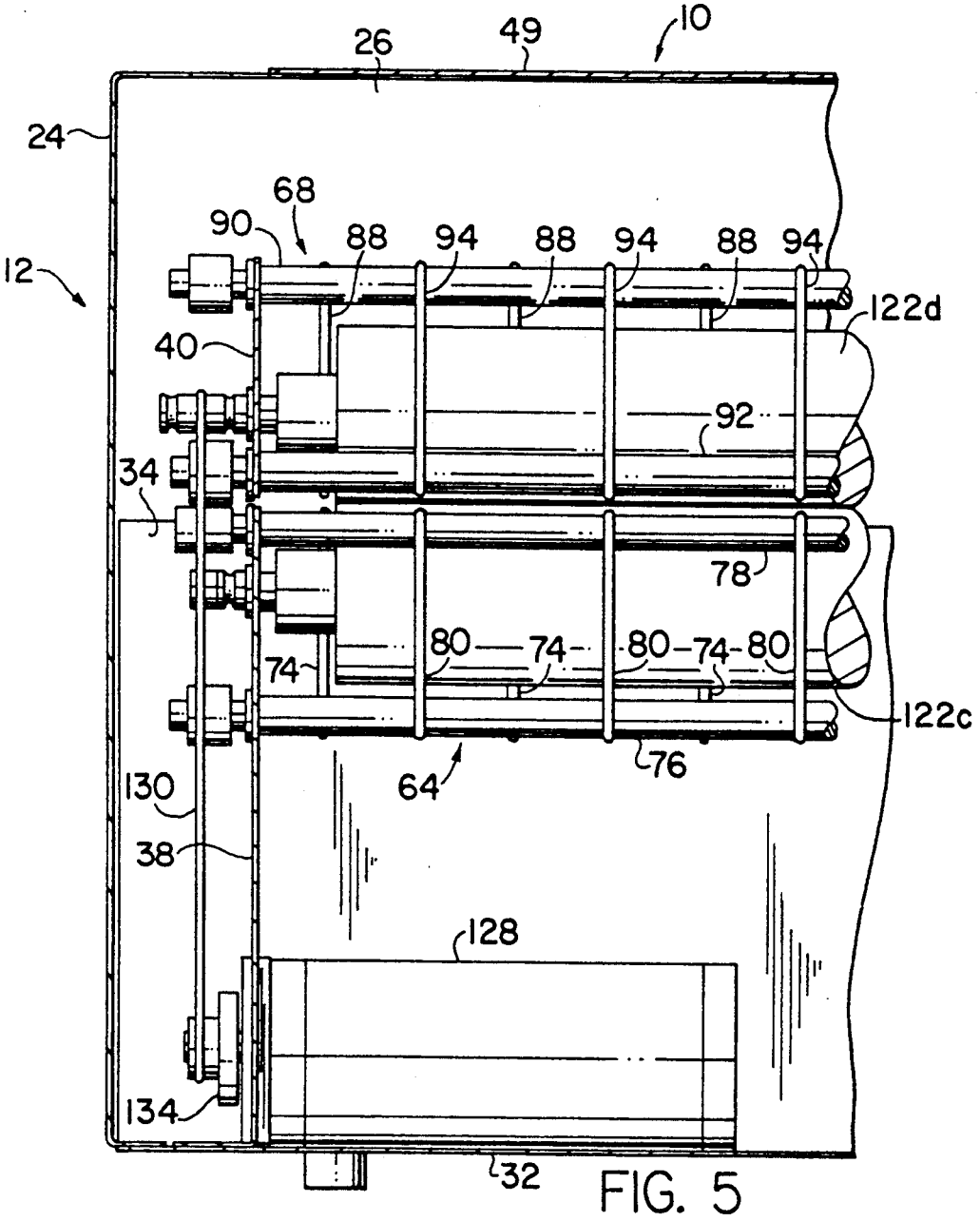
FIG. 5 is a sectional view taken along the line 5—5 of FIG. 2.

The frame 22 which is preferably fabricated from sheet metal, has a horizontal bottom wall 32, front and rear walls 34 and 36, which extend upwardly from the bottom wall, and vertically disposed opposing lower side plates 38,38 (one shown) spaced laterally inwardly from the side edges of the front and rear walls, as best shown in FIG. 5.

The frame has an upper portion defined by a pair of upper side plates 40,40. Each upper side plate 40 is disposed in vertically registry with an associated lower side plate 38 as best illustrated in FIG. 5 where one lower side plate 38 and an associated upper side plate 40 are shown. Each upper side plate 40 is connected to an associated lower side plate 38 by a pair of vertically disposed slotted connecting members 42,42. Vertical adjustment of the upper portion of the frame 22 relative to the lower lower portion thereof is facilitated by a plurality of captive adjusting screws 44,44 carried by the upper slide plates 40,40 and threadably engaged with nuts 41,41 mounted in fixed position on the lower side plates 38,38. Preferably, two such longitudinally spaced apart adjusting screws 44,44 are provided for vertically adjusting each upper side plate 40 relative to its associated lower side plate 38. The frame further includes a pair of laterally spaced apart outriggers 46,46 connected to the front wall 34 and projecting forwardly therefrom in parallel relation to each other.

A generally cylindrical soft resilient sealing member 47 is supported by and extends transversely between the upper side plates 40,40 at the rear end of the machine frame and cooperates in sealing engagement with the removable cover 24 substantially as shown in FIG. 2. A transparent window 49 in the top surface of the removable cover 24 provides a means for viewing the conveyor and cleaning mechanism within the housing 12 when the removable cover 24 is in place.

The conveyor assembly 18 is formed by a plurality of belt conveyors which include a feed conveyor, indicated generally at 48, and a drive conveyor, designated generally by the numeral 50. Each of the conveyors 48 and 50 has a transversely spaced apart series of longitudinally extending endless belts supported by axially elongated support rollers journalled for rotation about axes extending transversely of the machine frame 22. The belts may be made from any suitable material, but elastomeric belts are presently preferred.

The feed conveyor 48 includes support rollers 52 and 54 which are journalled on and extend between the outriggers 46,46 at the front end of the machine frame 22. A third support roller 56, which also comprises a part of the feed conveyor 48, is disposed within the housing 12 and is journalled on and extends between the lower side plates 38,38 inward of the inlet slot 28. A plurality of belts 58,58 are supported on and extend between the support rollers 52 and 54, as best shown in FIGS. 1 and 2. Another series of belts 60,60 are supported by and extend between the support rollers 54 and 56. The belts 60,60 are laterally offset relative to the belts 58,58, as will be apparent from FIG. 3.

The drive conveyor 50, best shown in FIG. 2, includes a pair of lower conveyor sections indicated generally at 62 and 64 and a pair of upper conveyor sections designated generally by the numeral 66 and 68. The lower section 62 is contiguous to the feed conveyor 48, shares the support roller 56 with the feed conveyor, and includes additional longitudinally spaced apart support rollers 70 and 72 which are journalled on and extend between the lower side plates 38,38. A plurality of endless elastomeric belts 74,74 are carried by the support rollers 56, 70 and 72, as best shown in FIG. 2. The belts 74,74 are laterally offset relative to the feed conveyor belts 60,60, as best shown in FIG. 2.

The lower conveyor section 64 is contiguous to the conveyor section 62 in that it shares the support roller 72 with the lower section 62. However, the lower section 64 also includes support rollers 76 and 78 which are journalled on and extend transversely between the lower sides plates 38,38. The support rollers 72, 76 and 78 cooperate to support a plurality of elastomeric endless belts 80,80 which are laterally offset relative to the belts 74,74, as shown best in FIG. 3.

Referring to FIG. 2, it will be noted that the support rollers 52, 54, 56, 72 and 78 are journalled for rotation about axes which lie within a substantially common horizontal plane so that the upper runs of the belts 58,58, 60,60, 74,74, and 80,80 are disposed substantially within a common horizontal plane to define a substantially horizontal path of travel for a sheet S into and through the machine 10. The support rollers 70 and 76 are disposed a substantial distance below the support rollers 56, 72 and 78 and provide space to accommodate sheet cleaning apparatus at the first and second cleaning stations 14 and 16 hereinafter further described.

The upper conveyor sections 66 and 68 are substantial mirror images of the respectively associated lower conveyor sections 62 and 64. Specifically, the upper conveyor section 66 includes support rollers 82, 84 and 86 which are journalled on and extend between the upper side plates 40,40 and support a plurality of endless elastomeric upper conveyor belts 88,88 which are preferably equal in number to the lower conveyor belts 74,74. Each upper conveyor belt 88 is preferably disposed in vertical alignment with an associated lower conveyor belt 74.

The upper conveyor section 68 includes the support roller 86 which forms a part of the upper section 66 and also has additional support rollers 90 and 92 which cooperate to support a plurality of endless elastomeric upper conveyor belts 94,94 which are preferably equal in number to and in vertical alignment with the lower conveyor belts 80,80.

Figure 4:
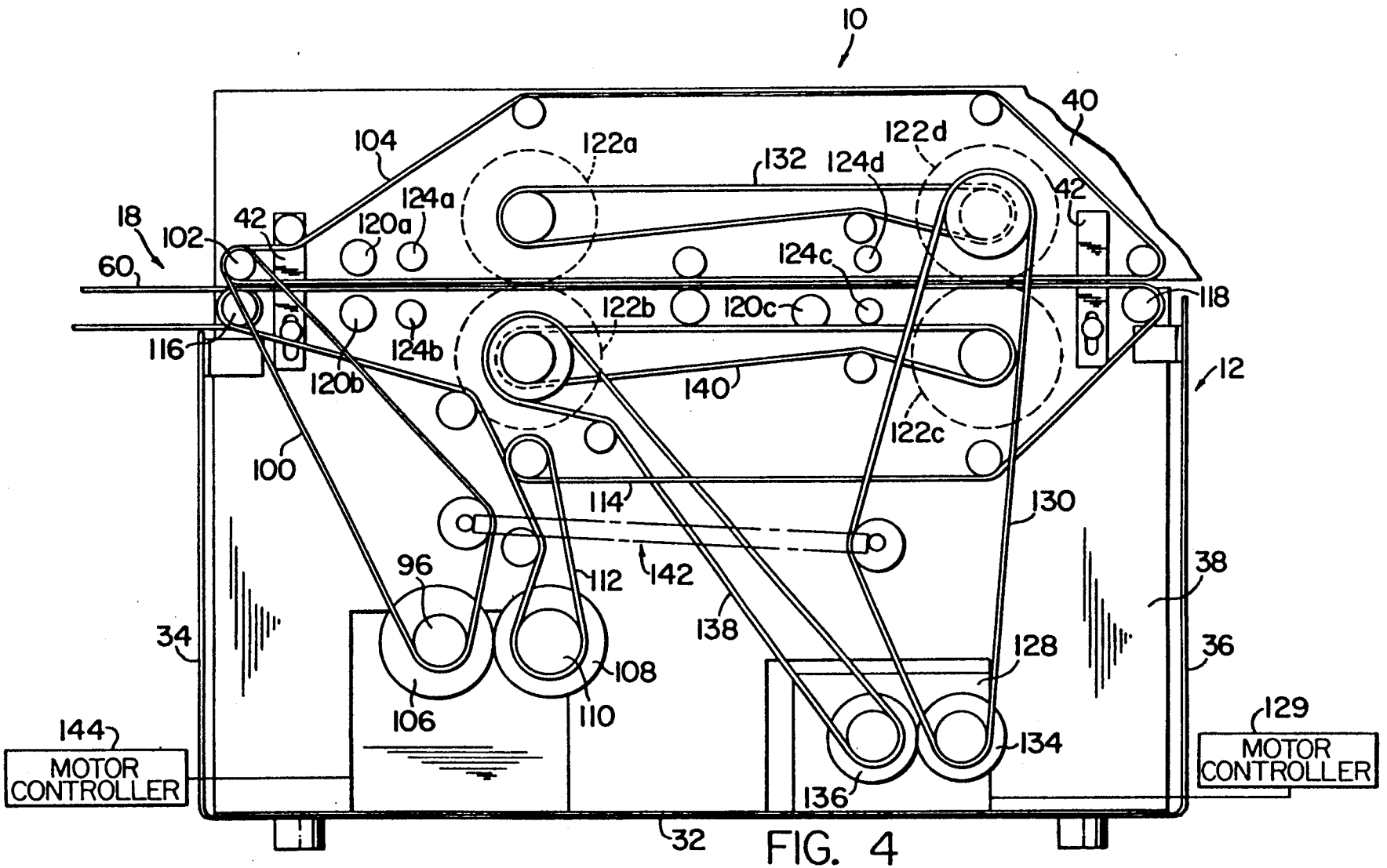
FIG. 4 is a sectional view taken along the line 4—4 of FIG. 3.

Timing belts and drive chains, located outboard of upper and lower side plates 40 and 38 at the right side of the machine 10, as viewed from the front and as shown in FIG. 4, drive the various conveyor sections which comprise the conveyor assembly 18. A drive pulley 96 mounted on the output shaft of a variable speed conveyor drive motor 98 drives a belt 100 coupled to another pulley 102 mounted on the support roller 82 to drive upper conveyor section 66. A sprocket mounted in fixed position on the support roller 82 drives a chain 104 which advances the upper conveyor sections 66 and 68 in timed relation to each other.

Figure 3:
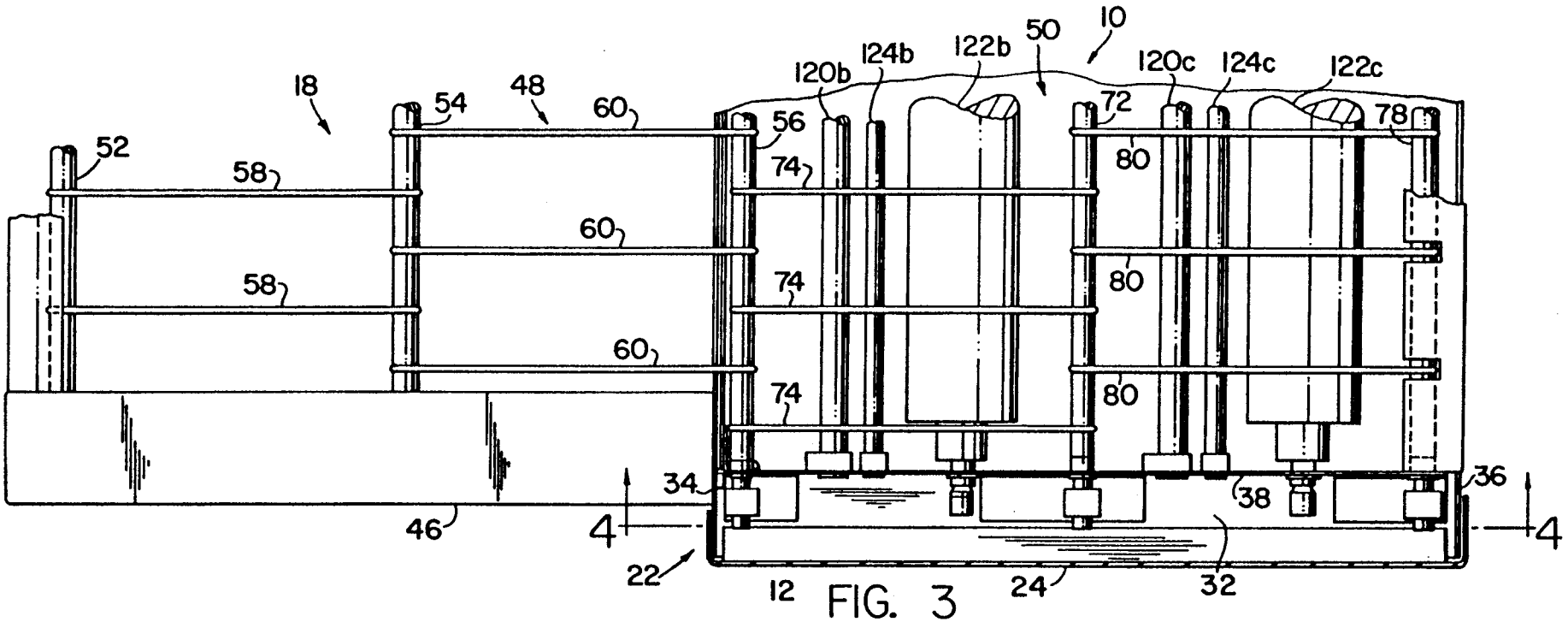
FIG. 3 is a sectional view taken along the line 3—3 of FIG. 2.

The lower conveyor sections 62 and 64 and the feed conveyor 48 are driven by a gear 106, mounted on the output shaft of the conveyor drive motor 98, which intermeshes with another gear 108 to drive a sprocket 110 and chain 112 which, in turn, drives another chain 114 coupled to sprockets 116 and 118 mounted on the support rollers 56 and 78, respectively, as best shown in FIG. 3. Thus, the feed conveyor 48 and the drive conveyor 50 are driven in timed relation to each other.

The cleaning apparatus located at the first cleaning station 14 includes first upper and lower surfaces cleaning devices. The first upper surface cleaning device comprises an ionizing or static eliminating bar **120*a* which extends transversely of the conveyor section 66 above and in close proximity to the lower run of the belts 88,88 and which is connected to a suitable high voltage source (not shown) to ionize the atmosphere in the immediate region of the bar 120*a* and thereby produce a neutralizing zone where static electrical charges associated with a sheet of material, such as a sheet S, and dust particles or other particulate matter which tend to cling to the sheet are neutralized as the sheet passes through the first cleaning station 14. The first upper cleaning device further includes an axially elongated rotary brush 122*a* journalled for rotation about a transverse axis relative to the conveyor path and above the lower run of the upper conveyor section 66. An air manifold 124*a*, which also comprises a part of the first upper cleaning device, extends transversely of the conveyor path for blowing jets of air toward the upper surface of a sheet, such as the sheet S as it passes through the first cleaning station 14. The manifold 124***a* is constructed and arranged so that the jets of air which emanate from it form a substantially continuous transversely extending air curtain which impinges on the upper surface of a sheet passing through the first cleaning station 14 to blow particulate material from the upper surface.

The first lower leaning device comprises a substantial mirror image of the first upper cleaning device, previously described, and will not be described in detail. Each part of the first lower cleaning device which corresponds to a substantially identical part of the first upper cleaning device previously described bears the same references numeral as the previously described part and a letter b suffix.

The cleaning apparatus at the second cleaning station also includes a second lower cleaning device which comprises a static eliminating bar 12O*c*, a rotary brush 122*c* and an air manifold 124*c* and is substantially identical to the first lower cleaning device previously described. A second upper cleaning device at the second cleaning station 16 has a rotary brush 122*d* and an air manifold 124*d*. The second upper cleaning device is similar to the first upper cleaning device but does not include a static eliminating bar.

Another ionizationing or static eliminating bar indicated at 120*d* and substantially identical to those previously described, is disposed immediately above and extends transversely of the conveyor path between the second cleaning station 16 and the outlet opening 30.

Referring again to FIG. 4, the cleaning brushes at the first and second cleaning stations 14 and 16 are driven in timed relation to each other by a reversible variable speed drive motor 128 controlled by a motor controller 129 and an associated timing belt and pulley mechanisms substantially as shown. Specifically, the motor 128 drives a belt 130 coupled to the upper cleaning brush 122*d*. Another belt 132 provides driving connection between the cleaning brush 122*d* and the other upper cleaning brush 122*a*. A gear 134 mounted in fixed position on the output shaft of the motor 128 intermeshes with another gear 136 which drives a belt 138 connected to the lower cleaning brush 122*b*. The lower cleaning brush 122*c* at the second cleaning station 16 is, in turn driven by a belt 140 coupled to the lower cleaning brush 122*b*. A spring tensioned idler mechanism indicated generally by the numeral 142 and connected between the main drive belts 100 and 130 enables vertical adjustment of the upper side plates 40,40 relative to the lower side plates 38,38 without requiring drive belt adjustment.

In preparation for using the machine 10 to clean sheet material, the vertical spacing between the upper conveyor sections 66 and 68 and lower conveyor sections 62 and 64 and between the upper and lower cleaning brushes is adjusted so that the upper and lower conveyor sections engage and grip the upper and lower surfaces of a sheet to be cleaned, such as the sheet S, to drive the sheet along the conveyor path through the housing 12. The adjusting screws 44,44 facilitate fine adjustment of the vertical spacing between the belts of the lower and upper conveyor sections 62,64 and 66,68.

A motor controller 144 regulates the speed of the conveyor drive motor which, in turn, determines the linear speed of the conveyor assembly 18. The setting for the linear speed of the conveyor assembly 18 is determined by the type of material to be cleaned.

If a flexible sheet is to be cleaned, the direction of brush rotation is set so that the cleaning brushes which rotate in opposite directions sweep the upper and lower surfaces of the sheet in the direction of sheet movement through the machine 10. The speed of the brush drive motor is preferably set so that the linear speed of the cleaning brushes is slightly greater than the linear speed of the conveyor assembly 18. This arrangement prevents buckling of the sheet material being cleaned, since the upper and lower cleaning brushes cooperate to exert slight pulling force on the sheet material in the direction of sheet travel as the sheet material passes through the first and second cleaning stations 14 and 16. Thus, the risk of sheet material buckling during the cleaning process is substantially eliminated. The pressure of the air fed to the air manifolds is also adjusted to assure that the blowing action of the air jets emanating from the manifolds 124*a*, 124*b*, 124*c* and 124*d* will be sufficient to blow particulate matter from the surfaces of the sheet material without causing excessive undulation or vibration of the material.

If the sheet to be cleaned comprises a rigid sheet or board, such as used in the manufacture of a printed circuit board or the like, the direction of brush rotation may be reversed so that the brushes sweep in a direction opposite the direction of sheet travel through the machine. The air pressure delivered to the manifolds may also be increased, if desired. However, excessive air pressure should be avoided to prevent agitation of particulate matter within the chamber 26 which might result in redepositing of particulate matter on the sheet material surfaces being cleaned.

Sheets to be cleaned are placed on the infeed end of the conveyor and are moved in succession through the inlet opening 28 and into the housing 12 wherein each successive sheet is gripped by the drive conveyor 50 and driven along the conveyor path through the chamber 26. As the sheet is driven through the first cleaning station portions of the surfaces are occluded by the conveyor belts 74,74 and 88,88. At the first cleaning station 14 the sheet passes between the upper and lower static eliminating bars 120*a*, 120*b* which neutralize static electrical charges on the sheet. This static neutralization may cause dust particles clinging to drop from the lower surface of the sheet and be drawn from the chamber 26 by the vacuum system 20. Thereafter, the sheet passes between the upper and lower air manifolds 124*a* and 124*b*, which blow particulate matter from the upper and lower surfaces of the sheet, and the rotary brushes 122*a*, and 122*b* which sweep particulate matter from the upper and lower surfaces of the sheet. The cleaning operation previously described is substantially repeated as the sheet is driven through the second cleaning station 16. However, only one static neutralizing bar is located at the second cleaning station. The laterally offset arrangement of the drive conveyor belts assures that portions of the surfaces of a sheet to be cleaned which are occluded or covered by drive belts as the sheet passes through the first cleaning station will be exposed as the sheet passes through the second cleaning station. As the drive conveyor 50 moves each sheet out of the housing through the outlet opening 30 the sheet passes under the static neutralizing bar 120*d* which neutralizes any residual electrical charges on the sheet which may have been produced by the air and brush scrubbing operations at the cleaning stations 14 and 16.

As the cleaned sheets leave the drive conveyor 50 the sheets drop into the open wire basket 15 at the discharge end of the machine 10.

We claim:

1. Sheet material cleaning machine comprising cleaning means for removing particulate matter from at least one surface of a sheet to be cleaned and including first and second cleaning stations and cleaning apparatus at each of said cleaning stations, and conveying means for positively driving a sheet such as aforesaid along a predetermined generally longitudinally extending path through said cleaning stations, said conveying means occluding a portion of the one surface of the sheet as the sheet is advanced through said first cleaning station and exposing the previously occluded portion of the one surface of the sheet to said cleaning apparatus at said second cleaning station as the sheet is further advanced through said second cleaning station, said conveying means including a first conveyor section for driving the sheet through said first cleaning station and a second conveyor section generally continuous to said first conveyor section for driving the sheet through said second cleaning station, each of said conveyor sections having a plurality of transversely spaced apart sheet engaging elements including upper sheet engaging elements for engaging the upper surface of the sheet and lower sheet engaging elements for engaging the lower surface of the sheet, said sheet engaging elements of said second conveyor section being transversely offset relative to said sheet engaging elements of said first conveyor section.

2. Sheet material cleaning machine as set forth in claim 1 where said conveyor assembly comprises a belt conveyor assembly and said sheet engaging elements comprise longitudinally extending belts.

3. Sheet material cleaning machine as set forth in claim 1 wherein said machine includes means for adjusting the vertical spacing between said upper and lower sheet engaging elements to accommodate sheets of varying thickness.

4. Sheet material cleaning machine as set forth in claim 1 including means for adjusting the speed of operation of said conveying means.

5. Sheet material cleaning machine as set forth in claim 1 wherein said cleaning means comprises static discharging means for neutralizing electrical charges associated with the sheet.

6. Sheet material cleaning machine as set forth in claim 5 wherein said static discharging means comprises means for ionizing the atmosphere in a region extending transversely of said path.

7. Sheet material cleaning means as set forth in claim 6 wherein said static discharging means comprises an elongated ionizing bar supported in fixed position and transversely extending relation to said path.

8. Sheet material cleaning machine as set forth in claim 1 wherein said cleaning means comprises manifold means for directing a curtain of air under pressure toward said path and extending transversely of said path to blow particulate matter from the one surface as the sheet is moved past the cleaning apparatus by the conveying means.

9. Sheet material cleaning machine as set forth in claim 1 wherein said cleaning apparatus includes an axially elongated generally cylindrical rotary brush supported for rotation about an axis extending transversely of said path and in sweeping engagement with the one surface as the sheet is moved past the cleaning apparatus by said conveying means and driving means for rotating said brush about its axis.

10. Sheet material cleaning machine as set forth in claim 9 wherein said driving means includes means for adjusting the rotational speed of said brush.

11. Sheet material cleaning machine as set forth in claim 10 wherein said driving means includes means for reversing the direction of rotation of said brush.

12. Sheet material cleaning machine as set forth in claim 1 wherein said machine includes a housing containing said cleaning means and vacuum producing means for evacuating said housing to remove particulate matter therefrom.

13. Sheet material cleaning machine as set forth in claim 1 wherein said cleaning means includes static discharging means located between said second cleaning station and the discharge end of said conveying means for neutralizing electrical static charges associated with the sheet as the sheet is moved to said discharge end by said conveying means.

14. Sheet material cleaning machine as set forth in claim 13 wherein said static discharging means comprises an elongated ionizing bar mounted in fixed position relative to and extending transversely of said path.

15. Sheet material cleaning machine comprising a housing having an upper part and a lower part cooperating to define a chamber and an inlet opening communicating with said chamber, conveying means for moving a sheet of material along a predetermined path through said inlet opening into said chamber and for driving the sheet of material along said path through said chamber from said inlet opening to and through said outlet opening, said conveying means engaging and occluding portions of the upper and lower surfaces of the sheet material as the sheet material is advanced along a first portion of the path through said chamber and exposing the portions of the upper and lower surfaces previously occluded by the conveying means as the sheet material is further advanced along a second portion of the path through said chamber by said conveying means, said conveying means including upper and lower conveyor sections carried respectively by said upper and lower housing parts, cleaning means disposed within said chamber for removing particulate material from both the upper and lower surfaces of the sheet of material at it is conveyed along said path relative to said cleaning means by said conveying means and including a first cleaning station associated with a first portion of said path for removing particulate matter from the upper and lower surfaces as the sheet material is advanced along said first portion of said path and having first cleaning apparatus including a first set of axially elongated generally cylindrical rotary cleaning brushes journalled for rotation about parallel axes extending transversely of said path, said first set including a first upper brush carried by said housing upper part and a first lower brush carried by said housing lower part, said cleaning means having a second cleaning station spaced along said path from said first cleaning station and associated with a second portion of said path for removing particulate matter from the upper and lower surfaces of the sheet material as the sheet material is advanced along said second portion of said path and including a second cleaning apparatus having a second set of axially elongated rotary cleaning brushes journalled for rotation about parallel axes extending transversely of said path and including a second upper brush carried by said housing upper part and a second lower brush carried by said housing lower part, and means adjusting the vertical portion of said upper part relative to said lower part to alter the vertical spacing between said upper and lower conveyor sections and said upper and lower cleaning brushes.

16. Apparatus for cleaning sheet material as set forth in claim 15 wherein said machine includes vacuum producing means for evacuating said chamber to remove particulate matter therefrom.

17. Sheet material cleaning machine as set forth in claim 15 wherein said cleaning apparatus includes static discharging means for neutralizing static electrical charges on the sheet of material as it is moved through the first and second cleaning stations by the conveying means.

18. Sheet material cleaning machine as set forth in claim 15 wherein said cleaning means includes means for blowing particulate matter from the upper and lower surfaces of a sheet of material as it is moved through the first and second cleaning stations by the conveying means.

19. Sheet material cleaning machine comprising a housing defining a chamber and having an inlet opening and a discharge opening communicating with said chamber, conveying means for moving a sheet of material along a predetermined path through said housing from said inlet opening to and through said discharge opening and exposing a portion of at least one surface of the material as the material is advanced along a first portion of the path through said chamber and exposing the remaining portion of said one surface as the material advances along a second portion of the path through said chamber, first cleaning means disposed within said chamber and associated with the first portion of said path for removing particulate matter from the exposed portion of said one surface as said material advances along the said first portion of said path, second cleaning means disposed within said chamber and associated with second portion of said path for removing particulate matter from said remaining portion of said one surface as the material advances along the second portion of said path, and vacuum producing means for evacuating said chamber.

20. Sheet material cleaning machine as set forth in claim 19 wherein said cleaning means includes static electric discharging means for neutralizing electrical charges associated with particulate matter on said one surface, means for brushing particulate matter from said one surface and means for blowing particulate matter from said one surface.

21. Sheet material cleaning machine comprising cleaning means for removing particulate matter from at least one surface of a sheet to be cleaned and including first and second cleaning stations and cleaning apparatus at each of said cleaning stations, and conveying means for moving a sheet such as aforesaid along a predetermined generally longitudinally extending path through said cleaning stations and occluding a portion of the one surface of the sheet as the sheet is moved through said first cleaning station and exposing the previously occluded portion of the one surface of the sheet to said cleaning apparatus at said second cleaning station as the sheet is moved through the second cleaning station, said cleaning apparatus including an axially elongated generally cylindrical rotary brush supported for rotation about an axis extending transversely of said path and in sweeping engagement with the one surface as the sheet is moved past the cleaning apparatus by said conveying means, driving means for rotating said brush about its axis, and means for adjusting the rotational speed of said brush.

22. Sheet material cleaning machine as set forth in claim 21 wherein said driving means includes means for reversing the direction of rotation of said brush.

* * * * *